United States Patent [19]

Nickolay et al.

[11] Patent Number: 4,870,720

[45] Date of Patent: Oct. 3, 1989

[54] ROVING GUIDE APPARATUS

[75] Inventors: Helmut Nickolay, Uhingen; Manfred Lattner, Ebersbach-Sulpach, both of Fed. Rep. of Germany

[73] Assignee: Zinser Textilmaschinen GmbH, Fed. Rep. of Germany

[21] Appl. No.: 193,339

[22] Filed: May 12, 1988

[30] Foreign Application Priority Data

Dec. 5, 1987 [DE] Fed. Rep. of Germany ..... 3715811
Jan. 21, 1988 [DE] Fed. Rep. of Germany ..... 3801687

[51] Int. Cl.[4] ..... D01H 5/72
[52] U.S. Cl. ..... 19/288
[58] Field of Search ..... 19/288, 292, 294, 258, 19/259; 57/315, 316

[56] References Cited

U.S. PATENT DOCUMENTS 4,387,487 6/1983 Nakahara et al. ..... 57/315
4,398,320 8/1983 Kubota et al. ..... 19/258
4,470,253 9/1984 Schulz et al. ..... 57/315
4,485,528 12/1984 Anahara et al. ..... 19/288

FOREIGN PATENT DOCUMENTS 1177461 1/1970 United Kingdom ..... 19/150
461323 of 1968 Fed. Rep. of Germany ..... 19/288
3327966 of 1985 Fed. Rep. of Germany ..... 19/288

*Primary Examiner*—Werner H. Schroeder
*Assistant Examiner*—Douglas E. Price
*Attorney, Agent, or Firm*—Shefte, Pinckney & Sawyer

[57] ABSTRACT

Apparatus for guiding the travel of roving between succeeding roller pairs at a spinning machine drafting station having telescoping tube members defining a roving guide channel therethrough and displaceable apart from one another to be variable in length for adjustable disposition between the nip areas of the successive roller pairs throughout a full range of different spacings therebetween.

17 Claims, 2 Drawing Sheets

FIG. 4
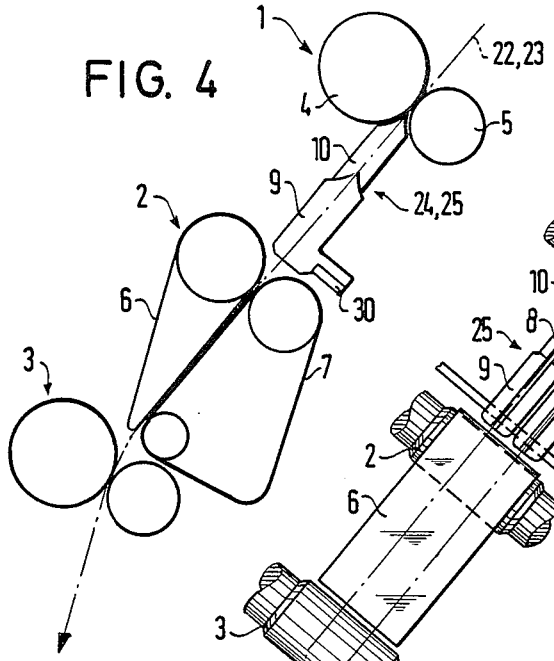
FIG. 5
FIG. 9
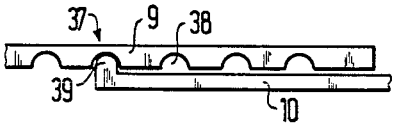
FIG. 6
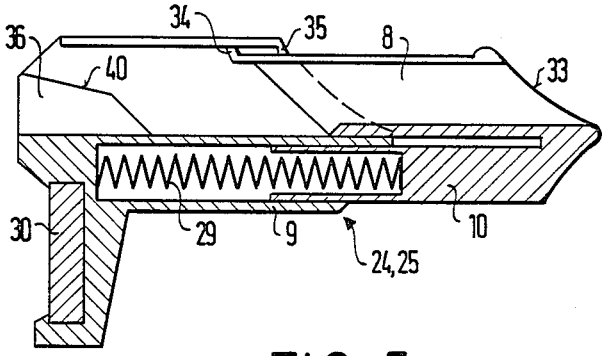
FIG. 8
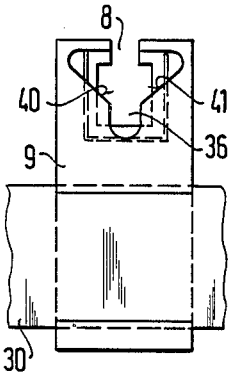
FIG. 7
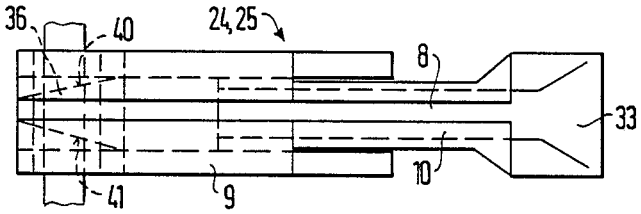

ROVING GUIDE APPARATUS

BACKGROUND OF THE INVENTION

The present invention relates to an apparatus for guiding roving travel between successive pairs of nip rollers at an operating station of a textile spinning machine.

When an operating station of a textile spinning machine is started, it sometimes occurs that the leading end of roving extending from one pair of drafting rollers is not properly inserted into the nip area between a next succeeding pair of drafting rollers. To address this problem, it is known to provide a table arranged between successive roller pairs on which the leading roving end can rest. However, this table arrangement has the disadvantage that tables of varying widths must be available for use when the spacing between the successive roller pairs is changed.

Moreover, practical experiences has shown that a roving end resting on such a table arrangement may be blown under the influence of a traveling blower device commonly operated to run along textile spinning machines to direct an air current to the drafting components to blow dust and fiber deposits therefrom, so that the roving end may still not be properly positioned in the nip of the succeeding roller pair upon start-up of the spinning machine despite the provision of such a table arrangement. Accordingly, this type of roving guide has proven in actual practice in industrial applications to be prone to faulty performance.

SUMMARY OF THE INVENTION

It is accordingly an object of the present invention to provide a roving guide apparatus for textile spinning machines which has a simple means for reliable reinsertion of a roving end into the nip of a succeeding pair of drafting rollers upon start-up of the spinning machine.

The present invention accomplishes this objective by providing a guide assembly which defines a roving guide channel extending between opposite end portions of the guide assembly and which is selectively variable in length, so that the guide assembly may be disposed between successive pairs of nip rollers at an operating station of a textile spinning machine with at least one of the end portions of the guide assembly projecting into the nip area of a respective one of the roller pairs. Advantageously, the roving guide channel provided by this guide assembly serves to guide the roving satisfactorily even if a change occurs in the spacing between the successive roller pairs and even if the operating system of the textile spinning machine is subjected to the effects of a traveling blower device.

In the preferred embodiment, the guide assembly comprises two tube members arranged telescopically with respect to each other with a suitable biasing device, e.g. a spring, urging the tube members apart, so that the guide assembly may be braced between the successive roller pairs. The roving guide channel at the upstream end portion of the guide assembly is of a dimension laterally with respect to the direction of roving travel to accommodate normal lateral traversing movement of a roving between the upstream pair of rollers. Similarly, the roving guide channel at the downstream end portion of the guide assembly is of a lateral dimension to accommodate normal lateral traversing of a roving between the downstream pair of rollers. In this manner, the roving is enabled to travel in and out of the guide channel at all traversing positions of the roving with respect to the roller pairs.

According to another feature of the present invention, the inwardly telescoping tube member is arranged upstream of the other telescoping tube member relative to the direction of roving travel to avoid interference with passage of the roving through the roving guide channel. The telescoping tube members are formed with aligned slots which open into the roving guide channel to facilitate insertion of the roving into the channel.

It is also a preferred feature of the present invention that the outward end of each telescoping tube member is configured in conformity with one roller, preferably the bottom roller, of the respective associated roller pair to extend from the nip area thereof more than 90 degrees along the bottom roller. In this manner, the guide assembly will be held in its desired position between the successive roller pairs when the respective upper rollers are separated from the bottom rollers, e.g., upon swing-up of one of the conventional carrier and loading arms of the top roller guide in a conventional spinning machine.

According to a further feature of the present invention, each of the telescoping tube members has a retaining portion at its outward end in the form of engagement members which project laterally opposite from the telescoping tube member for engagement with lateral flank areas of one of the rollers, preferably the bottom roller, of the associated roller pair at opposite sides of a drafting zone of the roller which typically is fluted and raised relative to the flank areas, thereby to prevent lateral displacement of the tube members with respect to the roller pairs.

The present invention also provides that the guide assembly may be constructed of a sufficiently narrow dimension laterally of the direction of roving travel to permit two of the guide assemblies to be arranged side-by-side between the successive roller pairs for separately guiding two rovings through the operating station of the spinning machine. This provision of two separate roving guide assemblies provides the advantage that the two rovings are maintained separate from one another as they pass through the successive roller pairs. Of course, as desired, each roving guide assembly may be arranged individually for handling a single roving in a normal spinning operation.

In order to insure correct relative positioning of two roving guide assemblies next to one another, it is preferred that one tube member of each guide assembly be mounted on a retaining bar or other retaining member with the other tube member of each guide assembly being displaceable with respect thereto. The retaining bars can traverse if necessary. A spring or similar biasing device is arranged between the fixed and displaceable tubes for urging the displaceable tube against one of the roller pairs, preferably the roller pair which is disposed upstream with respect to the direction of roving travel. The downstream tube member may be configured to define a downstream narrowing of the roving guide channel, which serves to improve the guiding effect of the assembly.

As an alternative to the use of a biasing spring between the tube members of the roving guide assembly, a detent arrangement may be provided for selectively fixing the displacement of the displaceable tube member with respect to the other tube member. For example, the detent arrangement may comprise a latch member and a plurality of compatible notches for receiving the latch member formed respectively on the tube members.

In the first alternative, the biasing spring forces the displaceable tube member into the nip between the adjacent pair of rollers. In the latter variant, the position of the displaceable tube is fixed by the detent arrangement as a function of the spacing of the roller pairs between which the roving guide assembly is arranged, providing the advantage of avoiding abrasive contact between the displaceable tube member and the adjacent roller pair.

BRIEF DESCRIPTION OF THE DRAWINGS

FIG. 4 is another schematic side view, similar to FIG. 1, showing another embodiment of the roving guide apparatus of the present invention in a drafting system of a textile spinning machine;

FIG. 5 is a top plan view of the drafting system and roving guide apparatus of FIG. 4;

FIG. 6 is an enlarged vertical cross-sectional view of the roving guide apparatus of FIG. 4;

FIG. 7 is a top plan view of the roving guide apparatus of FIG. 6;

FIG. 8 is a downstream end view of the roving guide apparatus of FIGS. 6 and 7; and FIG. 9 is a partial cross-sectional view, similar to FIG. 6, showing an alternate embodiment for positioning the two tube members of the roving guide apparatus relative to one another.

DESCRIPTION OF THE PREFERRED EMBODIMENT

Figure 1:
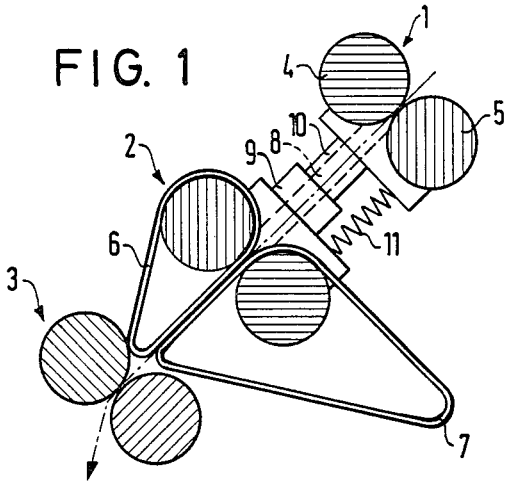
FIG. 1 is a schematic side view, shown partially in side elevation and partially in vertical cross-section, of a representative drafting system of a textile spinning machine incorporating the roving guide apparatus according to the preferred embodiment of the present invention.

Referring now to the accompanying drawings and initially to FIG. 1, a representative drafting system at an operating station of a textile spinning machine is shown schematically to include a series of three pairs of nip rollers, namely, an upstream pair of feed rollers, generally indicated at 1, an intermediate pair of drafting rollers, generally indicated at 2, about which an endless top apron 6 and an endless bottom apron 7 are guided in a conventional fashion not shown herein in detail, and a pair of delivery or withdrawal rollers, generally indicated at 3.

According to the present invention, a roving guide apparatus is disposed between the upstream feed roller pair 1, which consists of a top roller 4 and a bottom roller 5, and the succeeding downstream intermediate drafting roller pair 2. The present roving guide apparatus includes two tube members 9 and 10 assembled telescopically with respect to one another with a spring 11 extending between the tube members to urge them apart into braced engagement respectively with the two roller pairs 1, 2 to clamp the guide apparatus therebetween. Preferably, the inwardly telescoping tube member 10 is arranged upstream of the outwardly telescoping tube member 9 in relation to the direction of roving travel indicated by the arrow in FIG. 1, whereby the tube member 10 is engaged in the nip area between the feed rollers of the roller pair 1 and the tube member 9 is engaged in the nip area between the drafting rollers of the roller pair 2.

The tube members 9,10 of the roving guide apparatus define an interior roving guide channel 8 extending in alignment through the tube members 9,10. In order to insure insertion of the roving into the guide channel 8 within the tube members 9,10, the tube members 9,10 are formed with respective slots 12,13 formed in alignment with one another longitudinally through the upwardly facing surfaces thereof to open into the roving guide channel 8, as shown in FIGS. 2 and 3.

Figure 3:
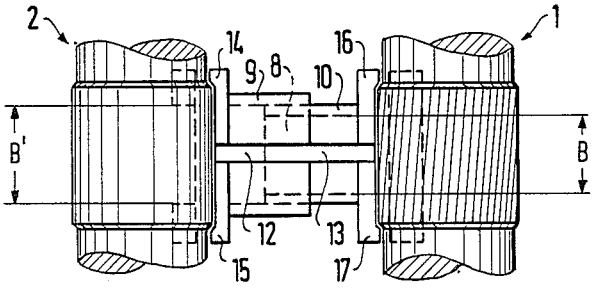
FIG. 3 is a top plan view of the roller pairs and roving guide apparatus of FIG. 2.

As further shown in FIG. 3, the telescoping tube member 9 is provided at its outward end with a retaining portion, formed by engagement members 14 and 15, projecting laterally oppositely from the sides of the tube member 9. Similarly, the tube member 10 has a retaining portion at its outward end formed by engagement members 16 and 17 which also project laterally from the opposite sides of the tube member 10. In this manner, the engagement members 14,15 and 16,17 are sufficiently laterally spaced at the outward ends of the tube members 9 and 10 to engage flank areas of reduced diameter at the opposite lateral ends of the large diameter fluted central drafting zone of at least one, and preferably both, of the bottom rollers of the roller pairs 1 and 2, thereby to prevent lateral displacement of the guide assembly with respect to the roller pairs 1 and 2.

Figure 2:
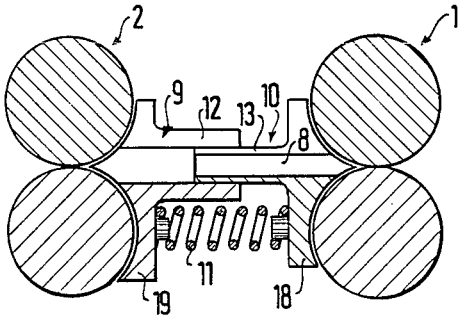
FIG. 2 is an enlarged and more detailed side elevational view of the two upstream pairs of drafting rollers and the present roving guide apparatus of FIG. 1.

As also seen in FIG. 2, the outward ends of each of the telescoping tube members 9 and 10 are of a tapering configuration conforming to the peripheries of the nip rollers of the roller pairs 1,2 to extend into the respective nip areas therebetween. Further, each of the telescoping tube members 9,10 includes a respective downwardly extending end area 18,19 extending in conformity to the respective bottom roller of the associated roller pair more than 90 degrees therealong from the nip area with the respective upper roller. In this manner, the telescoping tube members 9 and 10, and consequently the entire roving guide assembly are maintained in their described position braced between the bottom rollers of the roller pairs 1,2 under the biasing force of the spring 11, as illustrated in FIG. 2, to prevent undesired slippage or disengagement of the guide assembly out of such position even when the top rollers of the roller pairs 1,2 are separated from the bottom rollers, for example, upon swing-up of one of the carrier and loading arms provided on conventional spinning machines for guiding the top rollers of the successive roller pairs 1,2,3.

As shown in FIG. 3, the roving guide channel 8 as defined by the tube member 10 at the upstream end of the channel 8 is of a sufficient widthwise dimension B, i.e. taken laterally with respect to the direction of roving travel, to accommodate the normal lateral traversing movement of a roving between the feed roller pair 1, so that the roving will be received through the tube member 10 into the guide channel 8 from all normal positions the roving may pass between the feed rollers 1. Similarly, the downstream end of the guide channel 8 as defined by the tube member 9 is of a sufficient lateral widthwise dimension to accommodate normal lateral traversing movement of a roving between the succeeding downstream roller pair 2.

The described roving guide apparatus of the present invention, with telescoping tubes 9,10 defining the roving guide channel 8, is advantageous when used with a drafting system in a spinning machine equipped with a conventional roving stop motion (not shown) of the type providing a wedge-shaped clamping component operable to be inserted between the feed rollers 4,5 to lift the top feed roller 4 away from the associated bottom feed roller 5 and to clamp the roving against further traveling movement. Since the succeeding roller pair 2 and the associated top and bottom aprons 6,7 continue to run, the roving is separated between the two roller pairs 1 and 2. The roving guide apparatus of the present invention is accordingly operative to retain the leading end of roving clamped at the feed roller pair 1 within the guide channel 8 defined by the telescoping tube members 9,10 to insure that the roving end is properly delivered to the nip of the succeeding roller pair 2 upon start-up of the drafting system.

The present roving guide apparatus provides the additional advantage of assuring satisfactory guidance of the roving even when significant changes are made in the spacing between the two roller pairs 1 and 2, since an extended length of the inner telescoping tube member 10 is housed within the telescoping tube member 9 so that the tube members 9,10 may be braced under the biasing action of the spring 11 between the roller pairs 1,2 over a wide range of spacings between the roller pairs 1,2.

As a still further advantage, the roving guide channel 8 also serves to protect the extent of roving between the roller pairs 1,2 from any undesired effects of traveling blower operating along the spinning machine to direct a stream of air to the drafting components to blow dust and fiber deposits threfrom. The tube members 9,10 substantially cover the roving within the guide channel 8 to insure that the roving cannot be blown about by the traveling blower.

Referring now to FIG. 4 and 5, another embodiment of a roving guide apparatus according to the present invention is shown in operative disposition between roller pairs 1 and 2 in another representative drafting system of a textile spinning machine. The roving guide apparatus in this embodiment also includes a pair of tube members 9,10 telescopically assembled with respect to one another for defining a roving guide channel 8 longitudinally through the tube members 9,10, with aligned slots being formed in the upwardly facing surface of the tube members 9,10 for roving insertion into the guide channel 8. In this embodiment, the guide apparatus is of a sufficiently narrow overall dimension laterally with respect to the direction of roving travel to permit two of the guide apparatus, as indicated generally at 24 and 25, to be arranged side-by-side between the roller pairs 1,2 for separate guiding of two rovings 22,23 through the operating station of the spinning machine, as shown in FIG. 5.

FIG. 6 is more detailed vertical cross-sectional view of the roving guide apparatus of this embodiment. As shown, the downstream outer telescoping tube 9 of the guide apparatus is mounted in this embodiment on a transverse retaining bar 30, preferably by a depending clip portion projecting downwardly from the tube member 9, with the inwardly telescoping tube member 10 being displaceable with respect to the fixed tube member 9. A biasing spring 29 is arranged between the tube members 9,10 to urged the displaceable tube member 10 outwardly away from the fixed tube member 9 to engage the outward end of the tube member 10 against the roller pair 1 within the nip area between its top and bottom rollers 4,5. In this manner, the displaceable tube member 10 is disposed upstream of the outer tube member 9 in relation to the direction of roving travel. The tube members 9,10 are formed with respective projecting stops 34,35 to prevent the spring 29 from separating the tube members from one another, for example when the guide apparatus is detached from the spinning machine.

As seen in FIGS. 6,7 and 8, the fixed downstream telescoping tube 9 is interiorly formed with inwardly tapering surfaces 40,41 at opposite lateral sides of the guide channel 8 to form a narrowed area 36 of the guide channel 8 at the downstream end thereof from which the guided roving is delivered to the roller pair 2. In this manner, the guidance of each roving 22,23 is closed controlled transversely to the direction of roving travel at the location of roving delivery from the guide apparatus, which favorably affects the drafting operation of the succeeding drafting zone of the spinning machine.

Preferably, the narrowing 36 is restricted to the lower region of the roving guide channel 8 wherein the rovings 22,23 in each guide apparatus travel in the normal operation of the drafting system, as seen in particular in FIG. 8. The upper region of the guide channel 8 above the narrowed area 36 is unrestricted by the tapered surfaces 40,41 to provide a broader area which facilitates insertion of the roving upon start-up of the drafting system. The tapered surfaces 40,41 provide a funnel-like transition from the broader upper area to the narrowed area 36 so that the roving is automatically drawn into the narrow area during normal drafting operation of the spinning station.

In conformity to the narrowing 36 of the roving guide channel 8 produced by the converging tapered surfaces 40,41 within the tube member 9, the inward end of the inwardly telescoping tube member 10 is formed of a compatible configuration to enable the tube member 10 to be displaced telescopically inwardly within the tube member 9 toward the direction of roving travel in spite of the presence of the narrowing surfaces 40,41.

As a possible alternative to the use of the biasing spring 29 between the tube members 9,10, a detent arrangement, shown generally at 37 in FIG. 9, may be provided between the tube members 9,10 for selectively fixing the relative position of the displaceable tube 10. For this purpose, the fixed tube 9 mounted on the retaining bar 30 may be formed with a series of spaced notches 38 on its interior surface, with the displaceable tube 10 being provided with a latch member 39 projecting from its outer surface for selective engagement in any one of the notches of the tube member 9. As will thus be understood, the detent arrangement 37 provides the advantage of enabling selective control of the disposition of the displaceable tube member 10 with respect to the fixed tube member 9 as a function of the spacing between the roller pairs 1 and 2 to locate the outward end of the displaceable tube 10 at the nip of the roller pair 1 without abrasive engagement therewith.

Due to the narrow construction of the roving guide apparatus of this embodiment, it is possible to utilize two such guide apparatus 24,25 in the drafting system in a spinning/twisting application wherein two rovings 22,23 travel separately through the drafting system in close proximity and are brought together by twisting downstream of the final roller pair 3 of the drafting system, as depicted in FIG. 5. On the other hand, it is equally possible to employ only one of the roving guide apparatus 24 or 25 in a drafting system operating for normal spinning of a single roving. The provision of the roving guide channel 8 and its narrowed area 36 at its downstream delivery end provide a controlling guiding of the roving. Preferably, the outward end of the displaceable tube member 10 is contoured as indicated at 33 in FIGS. 6 and 7 in conformity to the nip area of the feed roller pair 1 so that the outward end of the tube member 10 may be positioned as closely as possible within the nip area.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. Apparatus for guiding roving travel between successive pairs of nip rollers at an operating station of a textile spinning machine, comprising guide means defining a roving guide channel beween opposite end portions of said guide means and being selectively variable in length for disposition between the successive roller pairs with at least one of said end portions of said guide means projecting into the nip areas of a respective one of the roller pairs.

2. Roving guide apparatus according to claim 1 and characterized further in that said guide means comprises two tube members arranged telescopically with respect to each other and means for biasing said tube members apart for clamping between said roller pairs.

3. Roving guide apparatus according to claim 1 and characterized further in that one said end portion of said guide means is located upstream with respect to the direction of roving travel and said roving guide channel at said upstream end portion is of a dimension laterally to the direction of roving travel to accommodate normal lateral traversing movement of a roving between the upstream pair of rollers.

4. Roving guide apparatus according to claim 1 and characterized further in that one said end portion of said guide means is located downstream with respect to the direction of roving travel and said roving guide channel at said downstream end portion is of a dimension laterally to the direction of roving travel to accommodate normal lateral traversing movement of a roving between the downstream pair of rollers.

5. Roving guide apparatus according to claim 2 and characterized further in that one said tube member telescopes inwardly of the other telescoping tube member and is arranged upstream of the other telescoping tube member with respect to the direction of roving travel.

6. Roving guide apparatus according to claim 2 and characterized further in that said telescoping tube members are formed with aligned slots which open into said roving guide channel.

7. Roving guide apparatus according to claim 2 and characterized further in that each said telescoping tube member includes a retaining portion at its outward end for preventing lateral displacement of said tube members with respect to the roller pairs.

8. Roving guide apparatus according to claim 7 and characterized further in that each said retaining portion comprises engagement members projecting laterally oppositely from its respective telescoping tube member for engagement of lateral flank areas of one of the rollers of the associated roller pair at opposite sides of a drafting zone of the one roller.

9. Roving guide apparatus according to claim 2 and characterized further in that the outward end of each telescoping tube is configured in conformity with one roller of the respective associated roller pair to extend from the nip area thereof more than ninety degrees (90°) along the one roller.

10. Roving guide apparatus according to claim 1 and characterized further in that said guide means is adapted for arrangement between an upstream feed roller pair and a downstream roller pair wherein a top motion means is provided for inserting a clamping component between the rollers of the feed roller pair.

11. Roving guide apparatus according to claim 1 and characterized further in that said guide means is of a sufficiently narrow dimension laterally of the direction of roving travel to permit two of said guide means to be arranged side-by-side between the successive roller pairs for respective guiding of two rovings.

12. Roving guide apparatus according to claim 1 or 11 and characterized further in that said guide means comprises two tube members arranged telescopically with respect to one another, one said tube member being mounted on a retaining member and the other said tube member being displaceable with respect thereto.

13. Roving guide apparatus according to claim 12 and characterized further by means arranged between said tube members for biasing said displaceable tube member against one of the roller pairs.

14. Roving guide apparatus according to claim 11 and characterized further in that said displaceable tube member is disposed upstream of the other said tube member with respect to the direction of roving travel.

15. Roving guide apparatus according to claim 14 and characterized further in that said other tube member defines a downstream narrowing of said roving guide channel.

16. Roving guide apparatus according to claim 12 and characterized further in that said guide means includes detent means for selectively fixing the displacement of said displaceable tube member with respect to the other said tube member.

17. Roving guide apparatus according to claim 16 and characterized further in that said detent means comprises a latch member and a plurality of compatible notches for receiving said latch member formed respectively on said tube members.

* * * * *